US009587442B2

(12) United States Patent
Thomas et al.

(10) Patent No.: US 9,587,442 B2
(45) Date of Patent: Mar. 7, 2017

(54) AUTOMATED LOCKING JOINT IN A WELBORE TOOL STRING

(71) Applicant: HALLIBURTON ENERGY SERVICES, INC., Houston, TX (US)

(72) Inventors: Sean Gregory Thomas, Allen, TX (US); Jack Gammill Clemens, Fairview, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 74 days.

(21) Appl. No.: 14/430,253

(22) PCT Filed: Mar. 20, 2014

(86) PCT No.: PCT/US2014/031289

§ 371 (c)(1),
(2) Date: Mar. 23, 2015

(87) PCT Pub. No.: WO2015/142333

PCT Pub. Date: Sep. 24, 2015

(65) Prior Publication Data

US 2016/0258228 A1 Sep. 8, 2016

(51) Int. Cl.
*E21B 17/05* (2006.01)
*E21B 17/20* (2006.01)
(Continued)

(52) U.S. Cl.
CPC ..... *E21B 17/05* (2013.01); *E21B 17/20* (2013.01); *E21B 23/002* (2013.01); *E21B 23/14* (2013.01); *E21B 47/06* (2013.01); *E21B 47/065* (2013.01)

(58) Field of Classification Search
CPC ..... E21B 31/14; E21B 17/05; E21B 7/067; F16L 27/0849; F16L 27/0853
(Continued)

(56) References Cited

U.S. PATENT DOCUMENTS 1,800,490 A * 4/1931 Young ..... E21B 31/14 175/268
2,304,119 A 12/1942 Potts
(Continued)

FOREIGN PATENT DOCUMENTS

EP 0298537 1/1989

OTHER PUBLICATIONS

International Patent Application No. PCT/US2014/031289 , International Search Report and Written Opinion, mailed Dec. 19, 2014, 10 pages.

*Primary Examiner* — George Gray
(74) *Attorney, Agent, or Firm* — Kilpatrick Townsend & Stockton LLP

(57) ABSTRACT

An automated locking joint can include a first member, a second member, a joint, a locking structure, and a positioning device. The joint can connect the first member with the second member. The second member can be pivotable about the joint relative to the first member. The locking structure can be positionable between a lock position that prevents pivoting of the second member about the joint and an unlock position that allows pivoting of the second member about the joint. The positioning device can automatically move the locking structure from the lock position to the unlock position or from the unlock position to the lock position.

20 Claims, 6 Drawing Sheets

(51) Int. Cl.
*E21B 23/12* (2006.01)
*E21B 23/14* (2006.01)
*E21B 47/06* (2012.01)

(58) Field of Classification Search
USPC ..... 285/118
See application file for complete search history.

(56) References Cited

U.S. PATENT DOCUMENTS

| | | | | |
|---|---|---|---|---|
| 2,459,614 | A * | 1/1949 | Brown | E21B 31/14 131/225 |
| 2,680,005 | A | 6/1954 | Storm et al. | |
| 3,446,297 | A | 5/1969 | Cullen et al. | |
| 3,457,999 | A | 7/1969 | Massey | |
| 4,278,137 | A | 7/1981 | Van Eek | |
| 4,303,135 | A | 12/1981 | Benoit | |
| 4,694,914 | A | 9/1987 | Obrecht | |
| 4,813,497 | A | 3/1989 | Wenzel | |
| 4,895,214 | A | 1/1990 | Schoeffler | |
| 4,928,776 | A | 5/1990 | Falgout | |
| 4,964,474 | A | 10/1990 | Poesch | |
| 5,094,304 | A | 3/1992 | Briggs | |
| 5,096,003 | A | 3/1992 | Kinnan | |
| 5,117,927 | A | 6/1992 | Askew | |
| 5,139,094 | A | 8/1992 | Prevedel et al. | |
| 5,154,243 | A | 10/1992 | Dudman | |
| 5,314,032 | A | 5/1994 | Pringle et al. | |
| 5,467,834 | A | 11/1995 | Hughes et al. | |
| 5,808,191 | A | 9/1998 | Alexy et al. | |
| 7,182,153 | B2 | 2/2007 | Moriarty | |
| 7,946,360 | B2 | 5/2011 | Orban et al. | |
| 8,360,172 | B2 | 1/2013 | Santelmann | |
| 8,360,174 | B2 | 1/2013 | Hall et al. | |
| 2006/0042835 | A1 | 3/2006 | Guerrero et al. | |
| 2006/0054322 | A1 * | 3/2006 | Rose | E21B 31/1135 166/301 |
| 2011/0240370 | A1 | 10/2011 | Shwets et al. | |
| 2011/0308858 | A1 | 12/2011 | Menger et al. | |

* cited by examiner

AUTOMATED LOCKING JOINT IN A WELBORE TOOL STRING

CROSS-REFERENCE TO RELATED APPLICATIONS

This is a U.S. national phase under 35 U.S.C. 371 of International Patent Application No. PCT/US2014/031289, titled "Automated Locking Joint in a Wellbore Tool String" and filed Mar. 20, 2014, the entirety of which is incorporated herein by reference.

TECHNICAL FIELD

The present disclosure relates generally to devices for use in a wellbore in a subterranean formation and, more particularly to automated locking joints in a wellbore tool string.

BACKGROUND

Various devices can be placed in a well traversing a hydrocarbon bearing subterranean formation. Some devices can include features that may be adjusted by hand. For example, a person may remove a pin or twist a collar on a device to prepare the device for installation into the well system. Adjusting devices by hand may place workers in proximity to moving parts, suspended heavy tools, or other potential hazards. Proximity to hazards when adjusting devices by hand may increase a risk of worker injury.

DETAILED DESCRIPTION

Certain aspects and examples of the present disclosure are directed to automated locking joints in a tool string. An automated locking joint can shift from a locked, rigid state to an unlocked, pivotable state without manual manipulation of the joint by a human operator. For example, the automated locking joint can shift between the locked and unlocked states in response to a change in pressure in an environment in which the joint is located, in response to a signal received by an actuator for the locking joint, etc.

These illustrative examples are given to introduce the reader to the general subject matter discussed here and are not intended to limit the scope of the disclosed concepts. The following describes various additional aspects and examples with reference to the drawings in which like numerals indicate like elements, and directional descriptions are used to describe the illustrative aspects. The following uses directional descriptions such as "above," "below," "upper," "lower," "upward," "downward," "left," "right," "uphole," "downhole," etc. in relation to the illustrative aspects as they are depicted in the figures, the upward direction being toward the top of the corresponding figure and the downward direction being toward the bottom of the corresponding figure, the uphole direction being toward the surface of the well and the downhole direction being toward the toe of the well. Like the illustrative aspects, the numerals and directional descriptions included in the following should not be used to limit the present disclosure.

Figure 1:
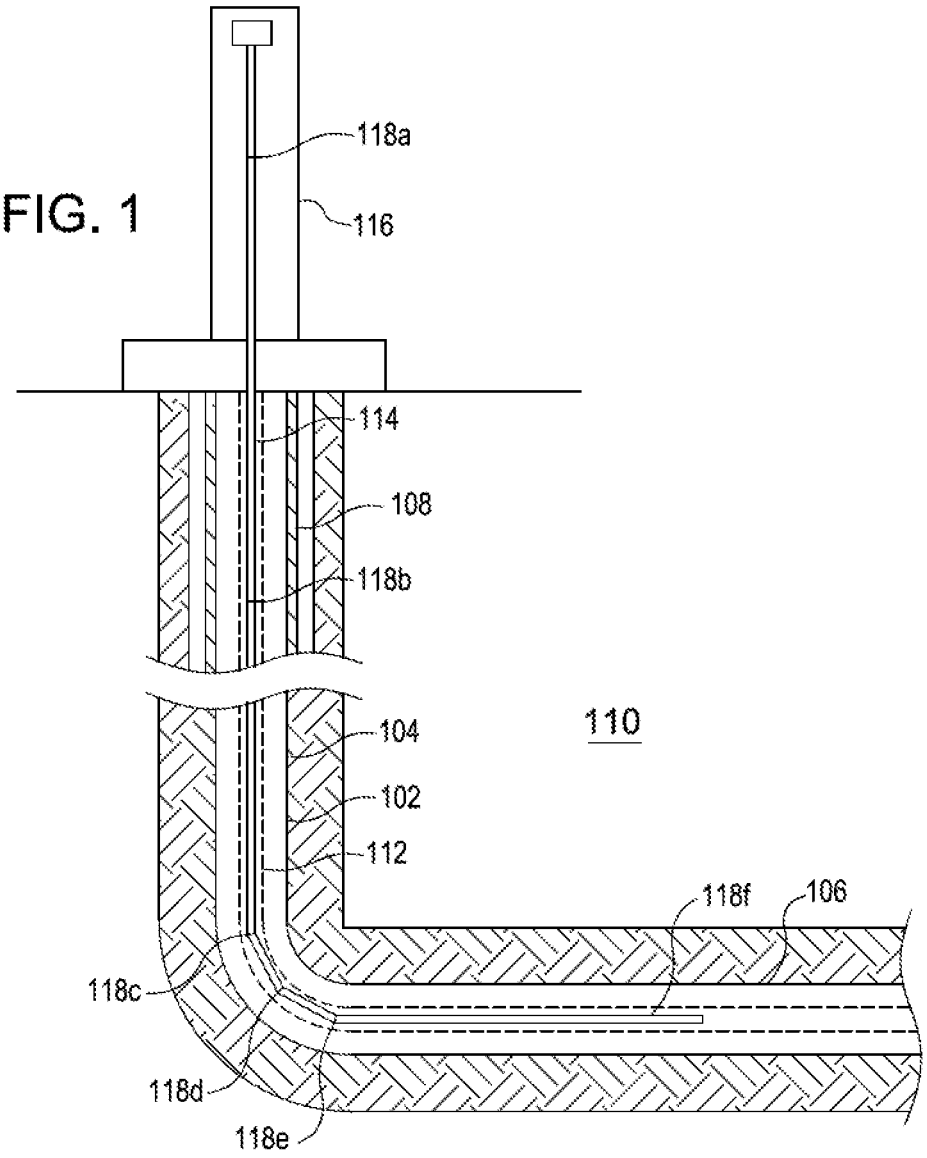
FIG. 1 is a schematic illustration of a well system including a tool string with automated locking joints according to one aspect of the present disclosure.

FIG. 1 schematically depicts an example of a well system 100 having one or more automated locking joints 118*a-f*. The well system 100 can include a bore that is a wellbore 102 extending through various earth strata. The wellbore 102 can have a substantially vertical section 104 and a substantially horizontal section 106. The substantially vertical section 104 can include a casing string 108 cemented at an upper portion of the substantially vertical section 104. In some aspects, the casing string 108 can extend into the substantially horizontal section 106. The substantially horizontal section 106 (or the substantially vertical section 104 or both) can extend through a hydrocarbon bearing subterranean formation 110.

A tubing string 112 within the wellbore 102 can extend from the surface to the subterranean formation 110. The tubing string 112 can provide a conduit for formation fluids, such as production fluids produced from the subterranean formation 110, to travel from the substantially horizontal section 106 to the surface. Pressure from a bore in a subterranean formation 110 can cause formation fluids, including production fluids such as gas or petroleum, to flow to the surface.

The well system 100 can also include a tool string 114. The tool string 114 can be deployed into the tubing 112 or into a portion of the well system 100 other than the tubing 112, such as a portion of the well system 100 that does not include tubing 112. In one example, the tool string 114 can be a wire line tool string, such as a tool string used for operating well service tools within the wellbore 102. In some aspects, the tool string 114 can include an electronic cable for conveying communications or power (or both) to tools deployed on the tool string 114.

The tool string 114 can be deployed from a housing 116 located at the surface of the well system 100. The housing 116 can be pressurized to match a pressure in the wellbore 102. Deploying the tool string 114 from within the housing 116 can allow the tool string 114 to be deployed into the wellbore 102 without losing pressure in the wellbore 102.

The well system 100 can also include one or more automated locking joints 118*a-f*. The automated locking joints 118*a-f* can be part of the tool string 114. Although the tool string 114 is depicted in FIG. 1 with six automated locking joints 118*a-f*, any number of automated locking joints 118 can be used, including one. The automated locking joints 118*a-f* can be locked or rigid in one portion of the well system 100 and unlocked or pivotable in another portion of the well system 100. In some aspects, the one or more automated locking joints 118*a-f* can facilitate a transition from the substantially vertical section 104 to the substantially horizontal section 106. For example, the automated locking joints 118*c-e* depicted in FIG. 1 can be in an unlocked state to allow the tool string 114 to bend as the wellbore 102 curves between the substantially vertical section 104 to the substantially horizontal section 106. The automated locking joint 118*f* can be in a locked state to prevent pivoting of the automated locking joint 118*f* as the tool string 114 is moved through the substantially horizontal section 106. In some aspects, an automated locking joint 118 can transition from an unlocked state to a locked state in response to a change position in the wellbore 102, such as from the position of automated locking joint 118*e* to the position of automated locking joint 118*f* depicted in FIG. 1.

Although FIG. 1 depicts the automated locking joint 118 in the well system 100, other arrangements are possible. In some aspects, automated locking joints 118 can be utilized in simpler wellbores, such as wellbores having only a substantially vertical section 104. Automated locking joints 118 can be utilized in openhole environments, as depicted in FIG. 1, or in cased wells. Automated locking joints 118 can be additionally or alternatively used in undersea wells, injections wells, or other well systems.

Figure 2:
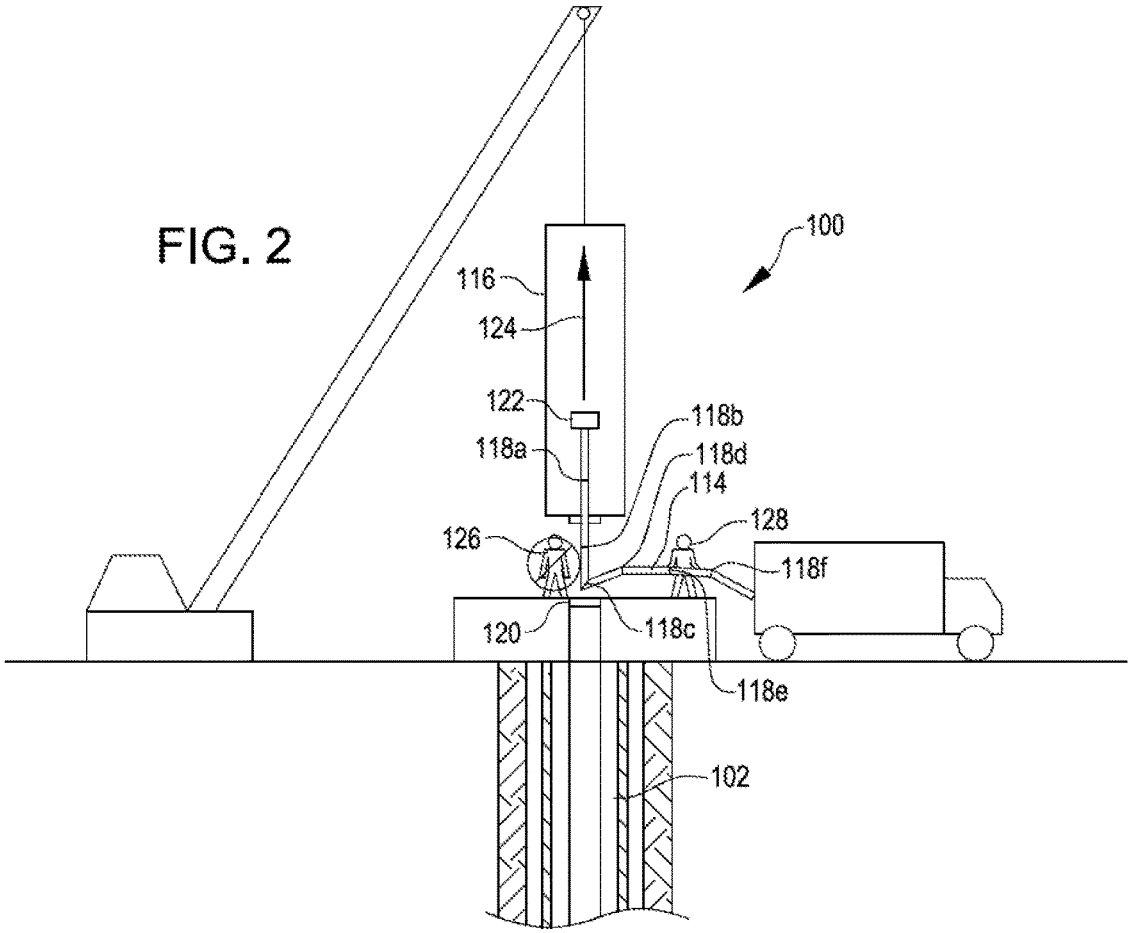
FIG. 2 is a schematic illustration of the tool string with automated locking joints of FIG. 1 being prepared for insertion into the wellbore according to one aspect of the present disclosure.

FIG. 2 is a schematic illustration of the tool string 114 with automated locking joints 118 of FIG. 1 being prepared for insertion into the wellbore 102 according to one aspect. The wellbore 102 can be sealed at a connection 120 with the housing 116. With the connection 120 sealed, the pressure in the housing 116 can be modified without causing a change in pressure in the wellbore 102. The housing 116 can be separated from the connection 120 to provide access to an interior of the housing 116 for loading or unloading tools into or out of the housing 116. For example, the tool string 114 with automated locking joints 118*a-f* can be inserted into the housing 116. The automated locking joints 118*a-f* can be in an unlocked state to provide flexibility for the tool string 114 during insertion into the housing 116. The automated locking joints 118*a-f* can change to a locked state in the housing 116 or the wellbore 102 to provide rigidity for operations such as applying axial forces via the tool string 114.

As will become apparent with respect to examples to be described herein, the change between locked and unlocked states of the automated locking joints 118 can be automated, i.e., without adjustment by hand or manual manipulation by a person. Automated locking or unlocking (or both) of the automated locking joints 118 can enhance the safety of workers 126, 128 during installation or removal of the tool string 114 from the well system 100. For example, the tool string 114 can be coupled with a tool positioner 122 located in the housing 116. The tool positioner 122 can pull the tool string 114 into the housing 116, such as in the upward direction depicted by the arrow 124 in FIG. 2. Automated locking of the automated locking joints 118 can reduce or eliminate an amount of time that a worker 126 might otherwise spend beneath the suspended housing 116 to activate locks by hand on the tool string 114. A worker 128 may remain a safe distance from the housing 116 to feed the tool string 114 into the housing 116. In some aspects, the tool string 114 with automated locking joints 118 can be loaded into the housing 116 without workers 126, 128 in close proximity to the housing 116. The housing 116 can be reattached to the connection 120 to allow the tool positioner 122 to deploy the tool string 114 into the wellbore 102.

Figure 3:
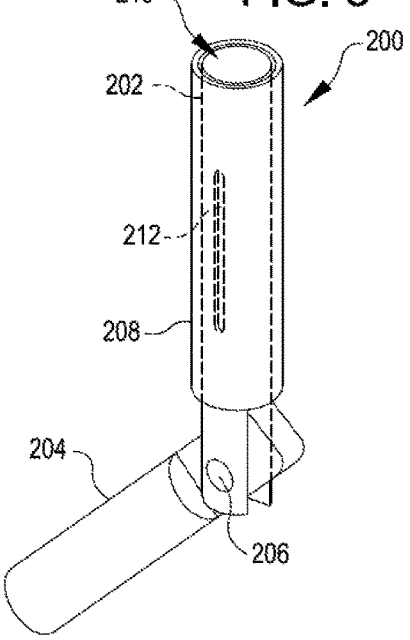
FIG. 3 is a perspective view of an example automated locking joint according to one aspect of the present disclosure.

Different types of automated locking joints 118 can be used in the well system 100 depicted in FIGS. 1 and 2. For example, FIG. 3 is a perspective view of an example of an automated locking joint 200 according to one aspect. The automated locking joint 200 can include a first member 202, a second member 204, a joint 206, a locking structure 208, a positioning device 210, and an opening 212.

The first member 202 and the second member 204 can be connected to one another via the joint 206. The first member 202 can be connected with a first portion of a tool string, such as the tool string 114 depicted in FIGS. 1-2. The second member 204 can be connected with a second portion of the tool string 114. The automated locking joint 200 can provide a point in the tool string 114 at which one portion of the tool string 114 can pivot about an adjacent portion of the tool string 114. For example, the joint 206 can allow the first member 202 to pivot about the second member 204. Although the joint 206 is depicted as a knuckle joint in FIG. 3, the joint 206 can be any suitable type of joint, including, but not limited to, a knuckle joint, a ball and socket joint, or a hinge joint. A non-limiting example of a ball and socket joint is joint 406 depicted in FIG. 7 below. The second member 204 can be pivotable about the joint 206 relative to the first member 202.

The locking structure 208 can be positioned external to the first member 202. The locking structure 208 can be positioned in an unlocked position that allows pivoting of the second member 204 about the joint 206 or the first member 202 (or both).

The positioning device 210 can be located internal to the first member 202. The positioning device 210 can automatically move the locking structure 208 from the unlocked position to a locked position (or vice versa). The positioning device 210 can thus provide automated locking of the automated locking joint 200.

Figure 4:
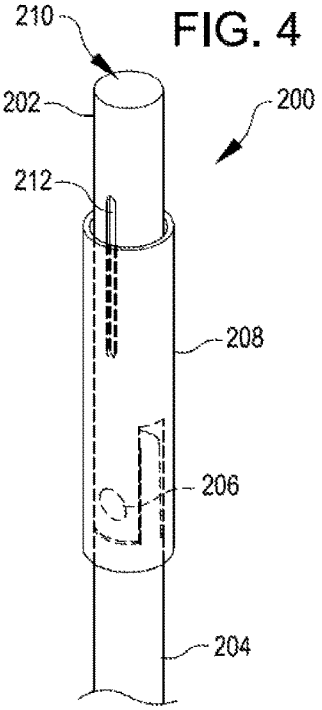
FIG. 4 is a perspective view of the example automated locking joint of FIG. 3 in a locked position according to one aspect of the present disclosure.

FIG. 4 is a perspective view of the automated locking joint 200 of FIG. 3 in a locked position according to one aspect. The locking structure 208 in the locked position can prevent pivoting of the second member 204 about the joint 206 or the first member 202 (or both). The first member 202 can include an opening 212. The positioning device 210 can be coupled with the locking structure 208 through the opening 212. The positioning device 210 can be operable for automatically moving the locking structure 208 between the unlocked position (such as depicted in FIG. 3) and the locked position (such as depicted in FIG. 4). In one example, the positioning device 210 can automatically move the locking structure 208 in response to a change in pressure in an environment in which the automated locking joint 200 is located.

Figure 5:
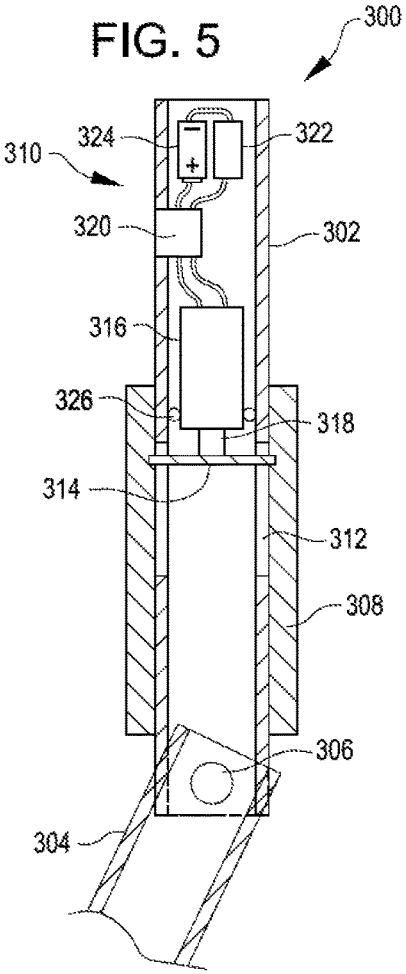
FIG. 5 is a cross-sectional view of an example automated locking joint having an electronic actuator according to one aspect of the present disclosure.

Various positioning devices 210, locking structures 208, and joints 206 can be used in an automated locking joint 200. For example, FIG. 5 is a cross-sectional view of an automated locking joint 300 having an electronic actuator 316 according to one aspect. The automated locking joint 300 can include a first member 302 coupled with a second member 304 via a joint 306. The joint 306 can be a knuckle joint 306. The automated locking joint 300 can include a locking structure 308. The locking structure 308 can be a locking sleeve 308. The automated locking joint 300 can include a positioning device 310 coupled with the locking sleeve 308 via a member 314 through an opening 312 through the first member 302. The member 314 can slide within the opening 312.

The positioning device 310 can be located within the first member 302. The positioning device 310 can include an electronic actuator 316, a shaft 318, a sensor 320, a printed circuit board 322, and a power source 324. The power source 324 can provide electrical power for electronics in the positioning device 310, such as the electronic actuator 316, the sensor 320, the printed circuit board 322, and other electronics. Non-limiting examples of the power source 324 include batteries, capacitors, and an electrical connection to another power source located remotely. In some aspects, the power source 324 may be omitted and power may be provided via an electric cable coupled to the automated locking joint 300 and conveyed through the tool string 114 that contains the automated locking joint 300.

The electronic actuator 316 can be coupled with the shaft 318 such that the electronic actuator 316 can move the shaft 318. In one example, the electronic actuator 316 can exert a linear force on the shaft 318 parallel with a longitudinal axis of the shaft 318. Non-limiting examples of the electronic actuator 316 include a solenoid and an electronic motor screw mechanism.

The sensor 320, the printed circuit board 322, and the power source 324 can be communicatively coupled with the electronic actuator 316. The printed circuit board 322 can include a processor device and a non-transitory computer-readable medium on which machine-readable instructions can be stored. Examples of a non-transitory computer-readable medium include random access memory (RAM) and read-only memory (ROM). The processor device can execute the instructions to perform various actions, some of which are described herein. For example, the printed circuit board 322 can activate the electronic actuator 316.

In some aspects, the sensor 320 can detect changes in parameters such as temperature, pressure, or time, or some combination thereof. A seal 326 can prevent fluids that pass through the opening 312 from flowing past the electronic actuator 316 to reach the other electronics, such as the sensor 320, the printed circuit board 322, or the power source 324. In some aspects, one or more of the electronics of the automated locking joint 300 can be located remotely from the first member 302 or from the automated locking joint 300.

Figure 6:
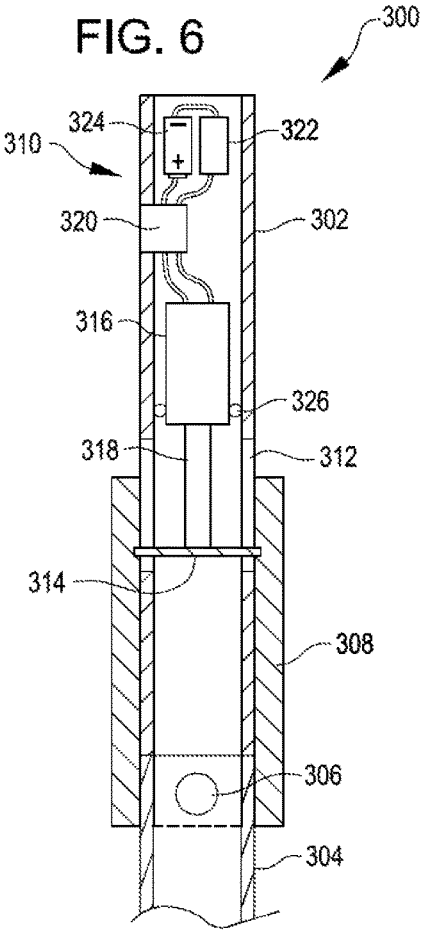
FIG. 6 is a cross-sectional view of the example automated locking joint of FIG. 5 in a locked position according to one aspect of the present disclosure.

FIG. 6 is a cross-sectional view of the automated locking joint 300 of FIG. 5 in a locked position according to one aspect. The printed circuit board 322 can receive readings from the sensor 320. The printed circuit board 322 can operate the electronic actuator 316 in response to measurements from the sensor 320. For example, the printed circuit board 322 can activate the electronic actuator 316 in response to a low-pressure threshold being reached and sensed by the sensor 320. Activation of the electronic actuator 316 can move the shaft 318. The shaft 318 can be coupled with the member 314. Movement of the shaft 318 can move the member 314, which may in turn move the locking sleeve 308. Movement of the locking sleeve 308 can shift the sleeve from an unlocked position to a locked position (such as from the position depicted in FIG. 5 to be position depicted in FIG. 6). In the locked position, the locking sleeve 308 can be positioned about both the first member 302 and the second member 304. Positioning the locking sleeve 308 about both the first member 302 and the second member 304 can constrain the second member 304 relative to the first member 302. The locking sleeve 308 in the locked position can prevent the second member 304 from rotating about the first member 302 or the joint 306 (or both).

The printed circuit board 322 can also cause the electronic actuator 316 to move the locking sleeve 308 from the locked position to the unlocked position. For example, the printed circuit board 322 can activate the electronic actuator 316 to withdraw or retract the shaft 318 in response to a high-pressure threshold detected by the sensor 320. Retracting the shaft 318 can cause the member 314 to move and consequently shift the position of the locking sleeve 308. Shifting the position of the locking sleeve 308 from a locked position (such as depicted in FIG. 6) to the unlocked position (such as depicted in FIG. 5) can allow the second member 304 to pivot about the first member 302 or the joint 306. Although the examples above describe the automated locking joint 300 locking in response to a low pressure and unlocking in response to a high pressure, in some aspects, the automated locking joint 300 can lock in response to a high pressure and unlock in response to a low pressure. For example, with respect to the housing 116 described above with respect to FIGS. 1-2, the automated locking joint 300 may lock in a relatively higher pressure environment as the housing 116 is pressurized to match the pressure in the wellbore 102 and unlock in a relatively lower pressure environment as the housing 116 is de-pressurized to provide access to the tool string 114 in the housing 116 apart from the wellbore 102.

Figure 7:
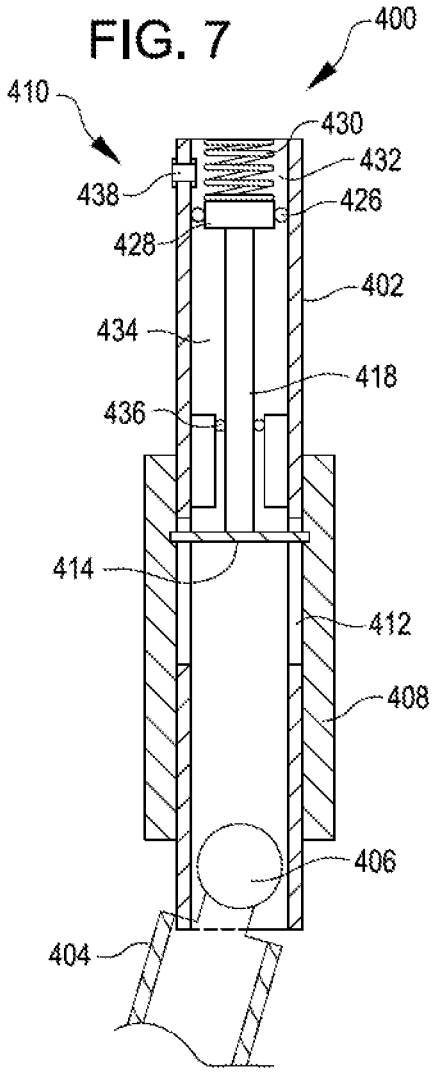
FIG. 7 is a cross-sectional view of an example automated locking joint having a pressure chamber according to one aspect of the present disclosure.

FIG. 7 is a cross-sectional view of an example of an automated locking joint 400 having a pressure chamber 432 according to one aspect. The automated locking joint 400 can include a first member 402, a second member 404, a joint 406, a locking structure 408, a positioning device 410, an opening 412, and a member 414. These features may function in a manner similar to features of the same name described with respect to previous figures.

The locking structure 408 can be a locking sleeve 408. The positioning device 410 of the automated locking joint 400 may include a piston 428 and a biasing member 430. The piston 428 can be positioned between a first chamber 432 and a second chamber 434. A seal 426 may prevent fluid communication between the first chamber 432 and the second chamber 434. The first chamber 432 can include a port 438 through an exterior or housing of the first member 402. The port 438 can provide a flow path for pressure communication from an environment in which the automated locking joint 400 is located. While the automated locking joint 400 is depicted with a joint 406 that is a ball and socket joint, other arrangements are possible. For example, the joint 406 could alternatively be a hinge joint, a knuckle joint, or any other suitable type of joint that allows pivoting of the second member 404 relative to first member 402. The second chamber 434 can include a second seal 436. The second seal 436 can prevent fluid communication into the second chamber 434 via the opening 412 in the first member 402 from an environment in which the automated locking joint 400 is located. Sealing the second chamber 434 with seals 426 and 436 can allow a pressure in the second 434 to be different from a pressure in the first chamber 432. The biasing member 430 can be coupled with the piston 428. A non-limiting example of the biasing member 430 is a spring. In some aspects, the biasing member 430 can be located in the first chamber 432.

Figure 8:
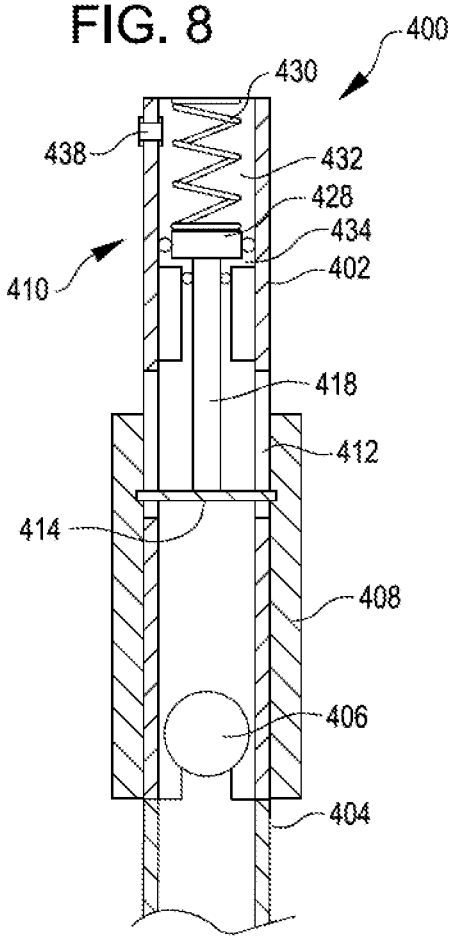
FIG. 8 is a cross-sectional view of the example automated locking joint of FIG. 7 in a locked position according to one aspect of the present disclosure.

FIG. 8 is a cross-sectional view of the automated locking joint 400 of FIG. 7 in a locked position according to one aspect. A pressure increase in the environment in which the automated locking joint 400 is located can result in a corresponding change of pressure in the first chamber 432. The port 438 can allow fluid communication from the environment into the first chamber 432 to communicate the change of pressure. The piston 428 can move in response to the pressure communicated to the piston 428 from the first chamber 432. The biasing member 430 can bias the piston 428 in a direction opposite the direction of movement that results from the pressure in the first chamber 432. Movement of the piston 428 can cause the member 414 to move. Movement of the member 414 can move the locking sleeve 408 from the unlocked position (such as depicted in FIG. 7) to the locked position (such as depicted in FIG. 8). The locking sleeve 408 in the locked position can prevent rotation or pivoting of the second member 404 relative to the first member 402. A pressure decrease in the environment in which the automated locking joint 400 is located can cause a corresponding change in pressure in the first chamber 432 as a result of fluid communication via the port 438. The biasing member 430 can exert an upward force on the piston 428 that is greater than the downward force exerted on the piston 428 by the pressure in the first chamber 432. The force differential can cause the biasing member 430 to move the piston 428 upward. Upward movement of the piston 428 can cause upward movement of the member 414 and the locking sleeve 408 via upward movement of the shaft 418, which may result in the locking sleeve 408 moving from the locked position to the unlocked position.

Figure 9:
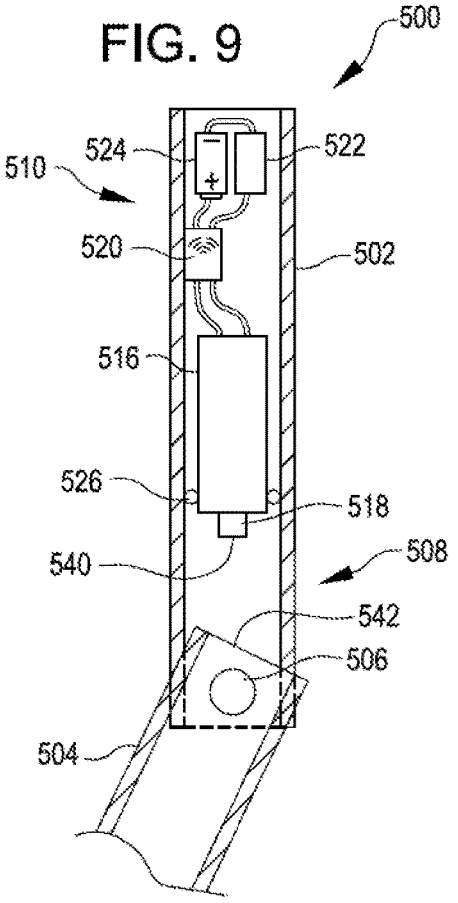
FIG. 9 is a cross-sectional view of an example automated locking joint having a communications link according to one aspect of the present disclosure.

In some aspects, the locking structure (such as the locking structure 208 described with respect to FIG. 3) can be located within the automated locking joint or internal to the first member. For example, FIG. 9 is a cross-sectional view of an example of an automated locking joint 500 having a communications link 520 according to one aspect of the present disclosure. The automated locking joint 500 can include a first member 502, a second member 504, a joint 506, a locking structure 508, and a positioning device 510. The positioning device 510 can include an electronic actuator 516, a printed circuit board 522, and a power source 524. The features of automated locking joint 500 can function in a manner similar to features of the same name described with respect to previous figures.

The positioning device 510 can also include a communications link 520. The communications link 520 can send or receive (or both) communication signals from a location remote from the automated locking joint 500. The communications link 520 can utilize any suitable communication protocol. In some aspects, the communications link 520 can use wireless communications, including, but not limited to, RFID signals or borehole mud telemetry. In additional or alternative aspects, the communications link 520 can use wired communications, including, but not limited to, an electronic control line carried via the tool string that contains the automated locking joint 500. In one example, the communications link 520 can receive signals from another tool that is part of the tool string that contains the automated locking joint 500. In another example, the communications link 520 can receive signals from a control center that is located at the surface of a well system. The control center may send signals to the communications link 520 based on input from a human operator of the system.

The printed circuit board 522 can activate the electronic actuator 516 in response to signals received via the communication link 520. The shaft 518 can move in response to activation of the electronic actuator 516. The shaft 518 can have a first surface 540. The second member 504 can have a second surface 542. The locking structure 508 can include the first surface 540 and the second surface 542. The second surface 542 can be exposed to the first surface 540 on the shaft 518. The first surface 540 and the second surface 542 can have complementary geometry. Non-limiting examples of complementary geometry include teeth and notches, mating profiles, and the like.

Figure 10:
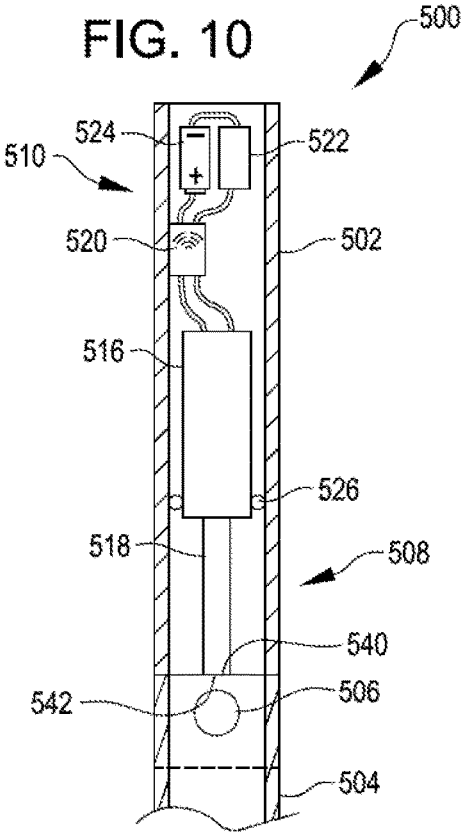
FIG. 10 is a cross-sectional view of the example automated locking joint of FIG. 9 in a locked position according one aspect of the present disclosure.

FIG. 10 is a cross-sectional view of the automated locking joint 500 of FIG. 9 in a locked position according one aspect. Extension of the shaft 518 in response to operation of the electronic actuator 516 can cause the shaft 518 to engage the second member 504. Engagement of the shaft 518 and the second member 504 can cause the first surface 540 on the shaft 518 to contact the second surface 542 on the second member 504. The contact between the first surface 540 and the second surface 542 can be an interfering contact. The interfering contact between the first surface 540 and the second surface 542 can lock the second member 504 relative to the first member 502. In one example, friction between the first surface 540 and the second surface 542 prevents the second member 504 from pivoting relative to the first member 502 or the joint 506 (or both). In another example, the mating geometry of the first surface 540 and the second surface 542 prevents the second member 504 from pivoting about the joint 506 and/or first member 502.

The printed circuit board 522 can reverse the electronic actuator 516 in response to a signal received via the communications link 520. Reversing the electronic actuator 516 can retract the shaft 518 such that the first surface 540 and the second surface 542 are positioned out of interfering contact with each other. Positioning the first surface 540 and the second surface 542 out of interfering contact can shift the automated locking joint 500 from the locked position (such as depicted in FIG. 10) to the unlocked position (such as depicted in FIG. 9).

Figure 11:
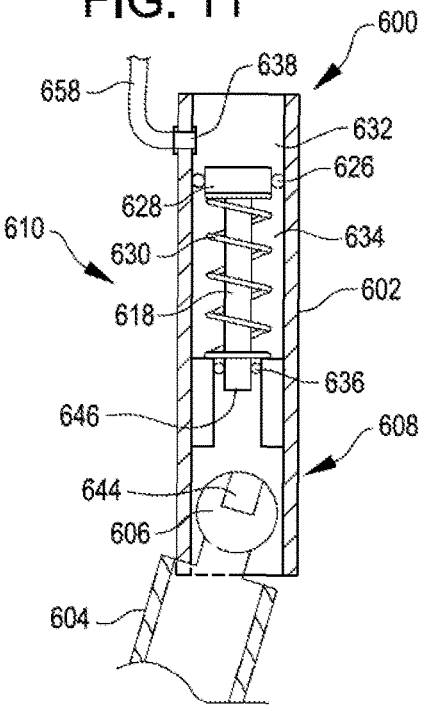
FIG. 11 is a cross-sectional view of an example automated locking joint having a bore in a ball of a ball and socket joint according to one aspect of the present disclosure.

FIG. 11 is a cross-sectional view of an example of an automated locking joint 600 having a bore 644 in a ball of a ball and socket joint 606 according to one aspect. The automated locking joint 600 can include a first member 602, a second member 604, a joint 606, a locking structure 608, and a positioning device 610. These features may function in a manner similar to features of the same name described with respect to previous figures. The automated locking joint 600 can include a first chamber 632, a second chamber 634, a piston 628, a shaft 618 and a biasing member 630. These features may function in a manner similar to features of the same name described with respect to previous figures, such as FIGS. 7 and 8. The positioning device 610 may include the piston 628 and the biasing member 630.

The ball of the ball and socket joint 606 may include a bore 644. The locking structure 608 can include the shaft 618 and the bore 644. A size of the bore 644 may correspond to a size of an end 646 of the shaft 618. In some aspects, the biasing member 630 can be positioned in the second chamber 634. In some aspects, the port 638 can provide a fluid path to an environment in which the automated locking joint 600 is located. In some aspects, the port 638 can provide a fluid path to a fluid control line 658. For example, the pressure in the first chamber 632 may depend upon a fluid control line 658 connected with the first chamber 632.

Although the fluid control line 658 is depicted in FIG. 11 as external to the first member 602, in some aspects the fluid control line 658 can be positioned internal to the first member 602. Controlling the fluid control line 658 can remotely control the automated locking joint 600. In one example, an operator can lock the automated locking joint 600 by introducing a pressure increase into the fluid control line 658.

Figure 12:
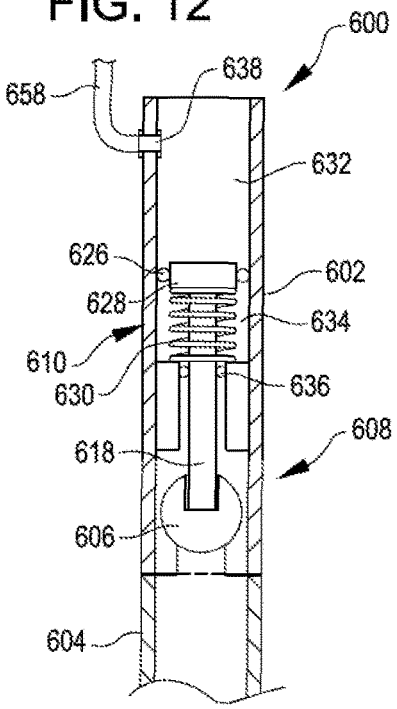
FIG. 12 is a cross-sectional view of the example automated locking joint of FIG. 11 in a locked position according to one aspect of the present disclosure.

FIG. 12 is a cross-sectional view of the automated locking joint 600 of FIG. 11 in a locked position according to one aspect. A pressure change may be introduced into the first chamber 632. In one example, the pressure may increase in response to an increase in pressure communicated via the port 638 from an environment in which the automated locking joint 600 is located. In another example, the pressure may change in response to a pressure change in a fluid control line 658 connected with the first chamber 632. The change in pressure in the first chamber 632 can cause the piston 628 to move. Moving the piston 628 can move the shaft 618. Moving the shaft 618 can position the end 646 of the shaft 618 into the bore 644 of the ball of the ball and socket joint 606. Positioning the end 646 of the shaft 618 in the bore 644 can cause the shaft 618 to engage the bore 644. Engagement of the shaft 618 and the bore 644 can constrain the joint 606. Constraining the joint 606 can prevent the second member 604 from pivoting relative to the first member 602. Inserting the shaft 618 into the bore 644 can put the automated locking joint 600 into a locked configuration. A reduction in pressure in the first chamber 632 (such as by a change in pressure in a fluid control line 658) can allow the piston 628 to move under the biasing force of the biasing member 630. Moving the piston 628 under the biasing force of the biasing member 630 can put the automated locking joint 600 into the unlocked configuration.

Figure 13:
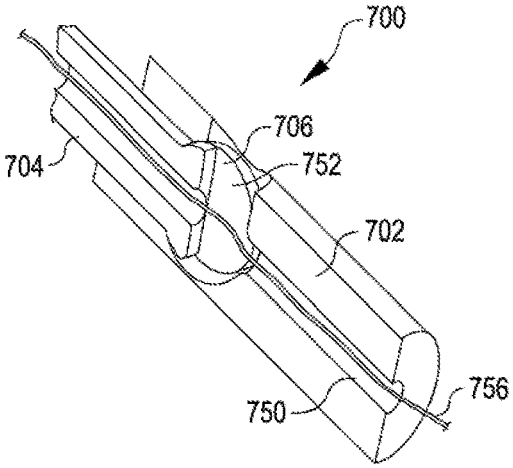
FIG. 13 is a perspective cross-sectional view of a portion of an example automated locking joint having a passage for a wire according to one aspect of the present disclosure.

In some aspects, a joint of an automated locking joint can be configured to allow passage of a wire therethrough. For example, FIG. 13 is a perspective cross-sectional view of a portion of an automated locking joint 700 having a passage 750 for a wire 756 according to one aspect. The automated locking joint 700 can include a joint 706 connecting a first member 702 and a second member 704. The automated locking joint 700 can include an internal passage 750. The passage 750 can extend through the first member 702, through the joint 706, and through the second member 704. The joint 706 can be a ball and socket joint. A void 752 can be positioned near an end of the second member 704, such as in the ball of the ball and socket joint 706. Although the automated locking joint 700 is depicted in FIG. 13 with the void 752 in the second member 704, the joint 706 can be installed in a reversed configuration such that the void 752 makes up a portion of the first member 702 of the automated locking joint 700. A wire 756 may be positioned within the passage 750. The wire 756 may convey communication signals or power (or both) through a tool string that contains the automated locking joint 700. For example, the wire 756 may correspond to an electronic cable in a tool string 114 as described above with respect to FIG. 1.

Figure 14:
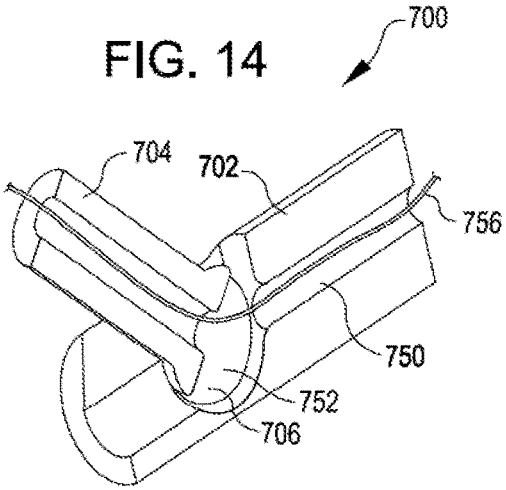
FIG. 14 is a perspective cross-sectional view of the example automated locking joint of FIG. 13 in a pivoted position according to one aspect of the present disclosure.

FIG. 14 is a perspective cross-sectional view of the automated locking joint 700 of FIG. 13 in a pivoted position according to one aspect. Pivoting the second member 704 about the joint 706 or the first member 702 can cause the void 752 to rotate. Rotating the void 752 can provide a space for the wire 756 to bend as the second member 704 pivots relative to the first member 702. Such an arrangement can provide a tool string with an automated locking joint 700 that does not damage or disconnect the wire 756 during pivoting at the joint 706.

In some aspects, an automated locking joint, a system, or a method is provided according to one or more of the following examples or according to some combination of the elements thereof. In some aspects, a tool or a system described in one or more of these examples can be utilized to perform a method described in one of the other examples.

Example #1

Provided can be an automated locking joint, comprising (i) a first member; (ii) a second member; (iii) a joint that connects the first member with the second member, the second member pivotable about the joint relative to the first member; and (iv) a locking structure automatically positionable between a lock position and an unlock position with respect to the joint based, at least in part, on a change in a pressure condition, the lock position preventing pivoting of the second member about the joint and the unlock position allowing pivoting of the second member about the joint.

Example #2

Provided can be the automated locking joint of Example #1, wherein the first member is connectable with a first portion of a wire line tool string, wherein the second member is connectable with a second portion of the wire line tool string, and wherein the joint is at least one of a ball and socket joint, a knuckle joint, or a hinge.

Example #3

Provided can be the automated locking joint of Example #1 (or any of Examples #1-2), wherein the locking structure includes a sleeve; wherein, in the lock position, the sleeve is positioned about the first member and the second member to prevent the second member from pivoting about the joint; and wherein, in the unlock position, the sleeve is positioned about the first member or about the second member to allow the second member to pivot about the joint.

Example #4

Provided can be the automated locking joint of Example #1 (or any of Examples #1-3), wherein the second member includes a bore and the locking structure includes a shaft insertable into the bore, wherein, in the lock position, the shaft is positioned at least partially within the bore to prevent the second member from pivoting about the joint, and wherein, in the unlock position, the shaft is positioned out of the bore to allow the second member to pivot about the joint.

Example #5

Provided can be the automated locking joint of Example #1 (or any of Examples #1-4), wherein the locking structure includes a first surface and the second member includes a second surface, wherein, in the lock position, the first surface is positioned in interfering contact with the second surface such that friction between the first surface and the second surface or mating geometry of the first surface and the second surface prevents the second member from pivoting about the joint; and wherein, in the unlock position, the first surface is positioned out of interfering contact with the second surface to allow the second member to pivot about the joint.

Example #6

Provided can be the automated locking joint of Example #1 (or any of Examples #1-5), further comprising (i) a piston in pressure communication with a pressure source and movable in a first direction in response to pressure communicated from the pressure source; and (ii) a biasing member coupled with the piston and biasing the piston in a second direction, wherein the piston is movable in the second direction by the biasing member in response to a change in pressure communicated from the pressure source, wherein the locking structure is coupled with the piston to move the locking structure between the lock position and the unlock position in response to movement of the piston.

Example #7

Provided can be the automated locking joint of Example #1 (or any of Examples #1-6), further comprising an electronic actuator coupled with the locking structure, wherein the locking structure is movable between the lock position and the unlock position in response to a force produced by the electronic actuator.

Example #8

Provided can be the automated locking joint of Example #7 (or any of Examples #1-7), wherein the electronic actuator includes at least one of a solenoid or a motor screw mechanism.

Example #9

Provided can be an automated locking joint of Example #1 (or Examples #1-8), further comprising (i) a passage through the first member, the joint, and the second member; and (ii) a wire positioned in the passage.

Example #10

Provided can be a downhole system, comprising (i) a first member; (ii) a second member pivotally coupled with the first member; (iii) a locking structure positionable between a lock position preventing pivoting of the second member about the first member and an unlock position allowing pivoting of the second member about the first member; (iv) an automatic positioning device coupled with the locking structure such that the locking structure is movable from the lock position to the unlock position or from the unlock position to the lock position in response to a change in pressure communicated to the automatic positioning device; and (v) a downhole assembly coupled with at least one of the first member or the second member, the downhole assembly including at least one of a drill string tool or a wire line tool.

Example #11

Provided can be the downhole system of Example #10, wherein the positioning device comprises (i) a piston in pressure communication with a pressure source and movable in a first direction in response to pressure communicated from the pressure source; and (ii) a biasing member coupled with the piston and biasing the piston in a second direction, wherein the piston is movable in the second direction by the biasing member in response to a change in pressure communicated from the pressure source; wherein the locking structure is coupled with the piston for moving of the locking structure between the lock position and the unlock position in response to movement of the piston.

Example #12

Provided can be the downhole system of Example #11 (or any of Examples #10-11), further comprising (i) a housing containing the piston and the biasing member; and (ii) a fluid path through the housing, wherein the pressure source is an environment in which the automated locking joint is positioned and the pressure source is in pressure communication with the piston via the fluid path.

Example #13

Provided can be the downhole system of Example #11 (or any of Examples #10-12), further comprising a fluid control line in fluid communication with the piston, wherein the pressure source is located remote from an environment in which the automated locking joint is positioned and the pressure source is in pressure communication with the piston via the fluid control line.

Example #14

Provided can be the downhole system of Example #10 (or any of Examples #10-13), wherein the locking structure includes a sleeve, wherein, in the lock position, the sleeve is positioned about the first member and the second member to prevent the second member from pivoting about the first member, and wherein, in the unlock position, the sleeve is positioned about the first member or about the second member to allow the second member to pivot about the first member.

Example #15

Provided can be the downhole system of Example #10 (or any of Examples #10-14), wherein the locking structure includes a shaft, wherein, in the lock position, the shaft is positioned in engagement with the second member to prevent the second member from pivoting about the first member, and wherein, in the unlock position, the shaft is positioned out of engagement with the second member to allow the second member to pivot about the first member.

Example #16

Provided can be a method, comprising (i) providing a joint in a wire line tool string, the joint having a first member, a second member pivotally coupled with the first member, and a locking structure positionable between a lock position preventing movement of the second member about the first member and an unlock position allowing movement of the second member about the first member; and (ii) moving the locking structure from the lock position to the unlock position or from the unlock position to the lock position in response to a change in input communicated to the joint.

Example #17

Provided can be the method of Example #16, wherein the change of input corresponds to a change in a parameter detected by a sensor associated with the joint, the parameter being at least one of a pressure of an environment in which the joint is located, a temperature of the environment, or a time.

Example #18

Provided can be the method of Example #16 (or any of Examples #16-17), wherein the change of input corresponds to a change in pressure communicated to the joint via a control line.

Example #19

Provided can be the method of Example #16 (or any of Examples #16-18), wherein the change of input corresponds to a signal communicated to the joint from a location remote from the joint.

Example #20

Provided can be the method of Example #19 (or any of Examples #16-19), wherein the signal is communicated by at least one of an electronic control line or a wireless communications link.

The foregoing description, including illustrated aspects and examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of this disclosure.

What is claimed is:

1. An automated locking joint, comprising:

a first member;

a second member;

a joint that connects the first member with the second member, the second member pivotable about the joint relative to the first member between an aligned position in which the first member and second member are axially aligned and a pivoted position in which the second member is positioned pivoted away from the aligned position; and a locking structure automatically positionable between a lock position and an unlock position with respect to the joint based, at least in part, on a change in a pressure condition, the lock position preventing pivoting of the second member about the joint from the aligned position to the pivoted position and the unlock position allowing pivoting of the second member about the joint, the second member being pivotable to the aligned position while the locking structure remains in the unlocked position;

wherein at least one of the first member or the second member is configured for operable coupling with a downhole assembly for facilitating operation of the downhole assembly.

2. The automated locking joint of claim 1, wherein the first member is connectable with a first portion of a wire line tool string, wherein the second member is connectable with a second portion of the wire line tool string, and wherein the joint is at least one of a ball and socket joint, a knuckle joint, or a hinge.

3. The automated locking joint of claim 1, wherein the locking structure includes a sleeve;

wherein, in the lock position, the sleeve is positioned about the first member and the second member to prevent the second member from pivoting about the joint; and wherein, in the unlock position, the sleeve is positioned about the first member or about the second member to allow the second member to pivot about the joint.

4. The automated locking joint of claim 1, wherein the second member includes a bore and the locking structure includes a shaft insertable into the bore;

wherein, in the lock position, the shaft is positioned at least partially within the bore to prevent the second member from pivoting about the joint; and wherein, in the unlock position, the shaft is positioned out of the bore to allow the second member to pivot about the joint.

5. The automated locking joint of claim 1, wherein the locking structure includes a first surface and the second member includes a second surface;

wherein, in the lock position, the first surface is positioned in interfering contact with the second surface such that friction between the first surface and the second surface or mating geometry of the first surface and the second surface prevents the second member from pivoting about the joint; and wherein, in the unlock position, the first surface is positioned out of interfering contact with the second surface to allow the second member to pivot about the joint.

6. The automated locking joint of claim 1, further comprising:

a piston in pressure communication with a pressure source and movable in a first direction in response to pressure communicated from the pressure source; and a biasing member coupled with the piston and biasing the piston in a second direction, wherein the piston is movable in the second direction by the biasing member in response to a change in pressure communicated from the pressure source;

wherein the locking structure is coupled with the piston to move the locking structure between the lock position and the unlock position in response to movement of the piston.

7. The automated locking joint of claim 1, further comprising an electronic actuator coupled with the locking structure, wherein the locking structure is movable between the lock position and the unlock position in response to a force produced by the electronic actuator.

8. The automated locking joint of claim 7, wherein the electronic actuator includes at least one of a solenoid or a motor screw mechanism.

9. The automated locking joint of claim 1, further comprising:

a passage through the first member, the joint, and the second member; and a wire positioned in the passage.

10. A downhole system, comprising:

a first member;

a second member pivotally coupled with the first member between an aligned position in which the first member and second member are axially aligned and a pivoted position in which the second member is positioned pivoted away from the aligned position;

a locking structure positionable between a lock position preventing pivoting of the second member about the first member from the aligned position to the pivoted position and an unlock position allowing pivoting of the second member about the first member, the second member being pivotable to the aligned position while the locking structure remains in the unlocked position;

an automatic positioning device coupled with the locking structure such that the locking structure is movable from the lock position to the unlock position or from the unlock position to the lock position in response to a change in pressure communicated to the automatic positioning device; and a downhole assembly coupled with at least one of the first member or the second member, the downhole assembly including at least one of a drill string tool or a wire line tool.

11. The downhole system of claim 10, wherein the positioning device comprises:

a piston in pressure communication with a pressure source and movable in a first direction in response to pressure communicated from the pressure source; and a biasing member coupled with the piston and biasing the piston in a second direction, wherein the piston is movable in the second direction by the biasing member in response to a change in pressure communicated from the pressure source;

wherein the locking structure is coupled with the piston for moving of the locking structure between the lock position and the unlock position in response to movement of the piston.

12. The downhole system of claim 11, further comprising:

a housing containing the piston and the biasing member; and a fluid path through the housing, wherein the pressure source is an environment in which the automated locking joint is positioned and the pressure source is in pressure communication with the piston via the fluid path.

13. The downhole system of claim 11, further comprising a fluid control line in fluid communication with the piston, wherein the pressure source is located remote from an environment in which the automated locking joint is positioned and the pressure source is in pressure communication with the piston via the fluid control line.

14. The downhole system of claim 10, wherein the locking structure includes a sleeve;

wherein, in the lock position, the sleeve is positioned about the first member and the second member to prevent the second member from pivoting about the first member; and wherein, in the unlock position, the sleeve is positioned about the first member or about the second member to allow the second member to pivot about the first member.

15. The downhole system of claim 10, wherein the locking structure includes a shaft;

wherein, in the lock position, the shaft is positioned in engagement with the second member to prevent the second member from pivoting about the first member; and wherein, in the unlock position, the shaft is positioned out of engagement with the second member to allow the second member to pivot about the first member.

16. A method, comprising:

providing a joint in a wire line tool string, the joint having a first member, a second member pivotally coupled with the first member between an aligned position in which the first member and second member are axially aligned and a pivoted position in which the second member is positioned pivoted away from the aligned position, and a locking structure positionable between a lock position preventing movement of the second member about the first member from the aligned position to the pivoted position and an unlock position allowing movement of the second member about the first member, the second member being pivotable to the aligned position while the locking structure remains in the unlocked position; and moving the locking structure from the lock position to the unlock position or from the unlock position to the lock position in response to a change in input communicated to the joint.

17. The method of claim 16, wherein the change of input corresponds to a change in a parameter detected by a sensor associated with the joint, the parameter being at least one of a pressure of an environment in which the joint is located, a temperature of the environment, or a time.

18. The method of claim 16, wherein the change of input corresponds to a change in pressure communicated to the joint via a control line.

19. The method of claim 16, wherein the change of input corresponds to a signal communicated to the joint from a location remote from the joint.

20. The method of claim 19, wherein the signal is communicated by at least one of an electronic control line or a wireless communications link.

* * * * *